US005639187A

United States Patent [19]

Mungall et al.

[11] Patent Number: 5,639,187

[45] Date of Patent: Jun. 17, 1997

[54] MARINE STEEL CATENARY RISER SYSTEM

[75] Inventors: John Christian Hartley Mungall, Lewisville; David Loyd Garrett, Carrollton; Charles H. Alexander, Plano, all of Tex.

[73] Assignee: Mobil Oil Corporation, Fairfax, Va.

[21] Appl. No.: 321,712

[22] Filed: Oct. 12, 1994

[51] Int. Cl.[6] ..... F16L 1/12; F16L 1/16

[52] U.S. Cl. ..... 405/195.1; 166/350; 405/169; 405/171

[58] Field of Search ..... 405/169, 170, 405/171, 195.1; 166/343, 350, 359, 367

[56] References Cited

U.S. PATENT DOCUMENTS

| | | | |
|---|---|---|---|
| 3,111,692 | 11/1963 | Cox . | |
| 3,327,780 | 6/1967 | Knapp et al. . | |
| 3,490,406 | 1/1970 | O'Reilly et al. | 405/224 X |
| 3,602,174 | 8/1971 | Gorman . | |
| 3,677,302 | 7/1972 | Morgan | 138/106 |
| 4,031,919 | 6/1977 | Ortloff et al. | 137/799 |
| 4,065,822 | 1/1978 | Wilbourn . | |
| 4,182,584 | 1/1980 | Panicker et al. | 405/195 |
| 4,188,156 | 2/1980 | Fisher et al. | 405/195 |
| 4,263,004 | 4/1981 | Joubert et al. | 405/171 X |
| 4,400,109 | 8/1983 | Gentry et al. | 405/195 |
| 4,400,110 | 8/1983 | Beynet et al. | 405/169 X |
| 4,421,436 | 12/1983 | Burns | 405/60 |
| 4,423,984 | 1/1984 | Panicker et al. | 405/195 |
| 4,478,586 | 10/1984 | Gentry et al. | 441/4 |
| 4,661,016 | 4/1987 | Baugh et al. | 405/169 |
| 4,673,313 | 6/1987 | Baugh et al. | 405/195 |
| 5,159,891 | 11/1992 | Lohr et al. | 114/230 |
| 5,275,510 | 1/1994 | de Baan et al. | 405/171 |
| 5,316,509 | 5/1994 | Boatman et al. | 441/3 |
| 5,437,518 | 8/1995 | Moloberti et al. | 405/169 |
| 5,505,560 | 4/1996 | Brown et al. | 405/195.1 |

OTHER PUBLICATIONS

"Deep Production Riser", Panicker et al, OTC 4512, Houston, Texas, May 2–5, 1983.

"Design and Installation of Auger Steel Catenary Risers", E.H. Phifer et al, OTC 7620, Houston, Texas, May 2–5, 1994.

*Primary Examiner*—Dennis L. Taylor

*Attorney, Agent, or Firm*—Malcolm D. Keen

[57] ABSTRACT

A marine riser system which effectively combines rigid (e.g. steel catenary risers) with flexible flowlines. Basically, the steel catenary risers, which are merely the end portion of submerged rigid flowlines, are curved upward through the water in a gentle catenary path to a large, submerged buoy, which, in turn, is moored to the bottom by tension leg tether lines at a depth below the turbulence zone of the water. Flexible flowlines are fluidly connected to the steel catenary risers at the buoy and extend upward through the turbulence zone to the surface.

10 Claims, 4 Drawing Sheets

MARINE STEEL CATENARY RISER SYSTEM

DESCRIPTION

1. Technical Field

The present invention relates to a marine riser system and a method for installing same in a body of water and in one of its aspects relates to a marine tension-legged buoy, steel catenary riser (SCR) system wherein the terminal end(s) of a rigid, (e.g. steel) submerged pipeline(s) is (a) curved upward in a gentle catenary from the marine bottom to a "tension leg" buoy which, in turn, is moored at a depth below the surface-action zone of the water and (b) then connected to a flexible conduit riser section(s) (i.e. jumpers) which extends in a catenary path from the buoy, up through the action zone to a facility floating on the surface.

2. Background Art

A critical consideration in the production of fluid hydrocarbons or the like from marine deposits lies in providing a fluid communication system from the marine bottom to the surface after production has been established. Such a system, commonly called a production riser or riser system, usually includes multiple conduits through which various produced fluids (e.g. oil, gas, water, etc.) are transported between the marine bottom and the surface of the water body. These may also include conduits to be used for off-loading lines, fluid injection lines and service, electrical, and hydraulic control lines.

In some offshore production (e.g. deep water), a floating platform or vessel is typically used as a surface production and/or storage facility. Since the moored or anchored facility is constantly exposed to surface and near surface conditions, it is continuously undergoing a variety of movements and forces. For example, in the "turbulence zone" (i.e. zone existing up to approximately 100 to 150 meters below the surface of an open body of water), a floating vessel may experience substantial heave, roll, pitch, drift, etc., caused by surface and near surface conditions (e.g. wave, wind, current, etc.).

In order for a production riser system to function adequately with most floating facilities, the riser system must be sufficiently compliant to compensate for the movements caused by the turbulence zone over long periods of operation without failure due to fatigue or the like.

There are several different types of known riser systems which have been proposed or used with floating facilities which are designed to compensate for and alleviate the adverse forces on the vessel due to the turbulence zone. One such type of riser systems uses a continuous, relatively flexible conduit(s) to form the link between the submerged pipeline(s) on the marine bottom and a floating facility on the surface (e.g. see U.S. Pat. No. 3,111,692; 3,677,302; 4,031,919; 4,065,822; and 4,188,156). However, flexible conduit risers are normally limited to relatively small internal diameters because of the high hydrostatic pressure and high tensile loads present in deep water environments.

Another well known type of riser is one sometimes referred to as a "compliant riser" such as disclosed and discussed in U.S. Pat. Nos. 4,182,584; 4,388,022; 4,400,109; and 4,423,984. As seen from these references, a typical compliant riser system includes (1) a vertically rigid section which extends from the marine bottom to a fixed position below the turbulence zone and (2) a flexible section which is comprised of truly flexible flowlines that extend from the top of the rigid section, through the turbulent zone, to a floating vessel on the surface. A submerged buoy is typically attached to the top of the rigid section to maintain the rigid section in a substantially vertical position within the water.

Due to the water depths in those production areas where compliant riser systems are designed to be used, difficulties arise in securing the lower end of the rigid section to the marine bottom in that at the depths involved, any substantial use of divers in the installation is impractical, if not impossible. Further, the depths are such that the use of guidelines for installing the riser and/or lower components thereof is also limited. Accordingly, the lower end of the rigid section must be capable of being remotely installed without any substantial assistance from divers or without the aid of guidelines to the surface. This can involve substantial expense in installing and servicing such riser systems.

Recently, it has been proposed to lay a substantially rigid (e.g. steel) pipeline from a subsea well or other fluid source on the marine bottom with conventional submerged pipelaying techniques and then curve one end of the pipeline upward in a gentle catenary path through the tubulence zone and connect it directly to the floating vessel on the surface; see "Design and Installation of Auger Steel Catenary Risers", E. H. Phifer et al, OTC 7620, 26th Annual Offshore Technology Conference, Houston, Tex., May 2–5, 1994. These risers are commonly referred to as Steel Catenary Risers or "SCR's".

While SCR systems may offer some advantages over other known riser systems, the catenary portion of the rigid pipeline which passes through the turbulence zone still must undergo and withstand the significant forces exerted thereon. Accordingly, these catenary portions require additional wall thickness to counteract and withstand the fatigue and dynamic loads exerted thereon. Further, the steel pipelines when connected directly to the floating vessel impose loads thereon which can be substantially greater than the loads imposed by the other riser systems. Still further, if the catenary portion of the pipeline undergoes fatigue or becomes damaged to the point of failure or possible failure, a large section of the submerged pipeline has to be replaced which is both expensive and extremely difficult to accomplish.

DISCLOSURE OF THE INVENTION

The present invention provides a marine riser system which effectively combines rigid (e.g. steel catenary risers (SCR)) and flexible flowlines to provide fluid communication between the marine bottom and the surface of a body of water. Basically, the steel catenary risers—which are merely the "free" ends of the bottom-supported rigid flowlines or pipelines as said flowlines are being laid—are curved upward through the water in a gentle catenary path to a large, submerged buoy, which, in turn, is moored to the bottom by tension leg tether lines at a depth below the turbulence zone of the water. Flexible flowlines are connected to the steel catenary risers at the buoy and extend through the turbulence zone to the surface where they are normally connected to a floating vessel or the like.

More specifically, the present marine riser system is one which is installed in the following basic steps: (1) installing the submerged buoy; (2) installing the rigid flowlines along the marine bottom, said rigid flowlines having one end adapted to be connected to a fluid source; (3) attaching the other ends of the flowlines to the buoy; and (4) installing the flexible flowlines between the buoy and a floating vessel. First, four piles are installed into the marine bottom. A tether line is connected to each of the piles. The buoy is towed to site and then lowered and connected to the tether lines. The parallel tether lines are attached at each of the "four corners" of the buoy and provide "tension leg" mooring lines for the buoy thereby minimizing any rotation of the buoy due to horizontal forces.

After the buoy is moored to the marine bottom, the rigid pipelines or flowlines are then laid from remote submerged, fluid sources by any conventional submerged pipeline laying technique. The steel catenary riser (SCRs) on each of the rigid flowlines is merely a continuation of the flowline itsself, and is curved upward in a catenary path from the marine bottom to the moored buoy as the flowline is being laid toward the buoy. The SCRs are connected to the buoy one at time, in a planned sequence.

The buoy and the SCRs can be pre-installed before the floating production vessel arrives on site, after which flexible conduits (i.e. jumpers) are connected to the SCRs at the moored buoy. Since the jumpers only lie in the shallower depths (e.g. 300 meters or less) of the body of water, they are not subjected to high tensile loads or high external hydrostatic pressures. It is, therefore, possible to use larger diameter flexible conduit than would be possible at greater water depths.

BRIEF DESCRIPTION OF THE DRAWINGS

The actual construction, operation, and apparent advantages of the present invention will be better understood by referring to the drawings in which like numerals identify like parts and in which.

BEST KNOWN MODE FOR CARRYING OUT THE INVENTION

Figure 1:
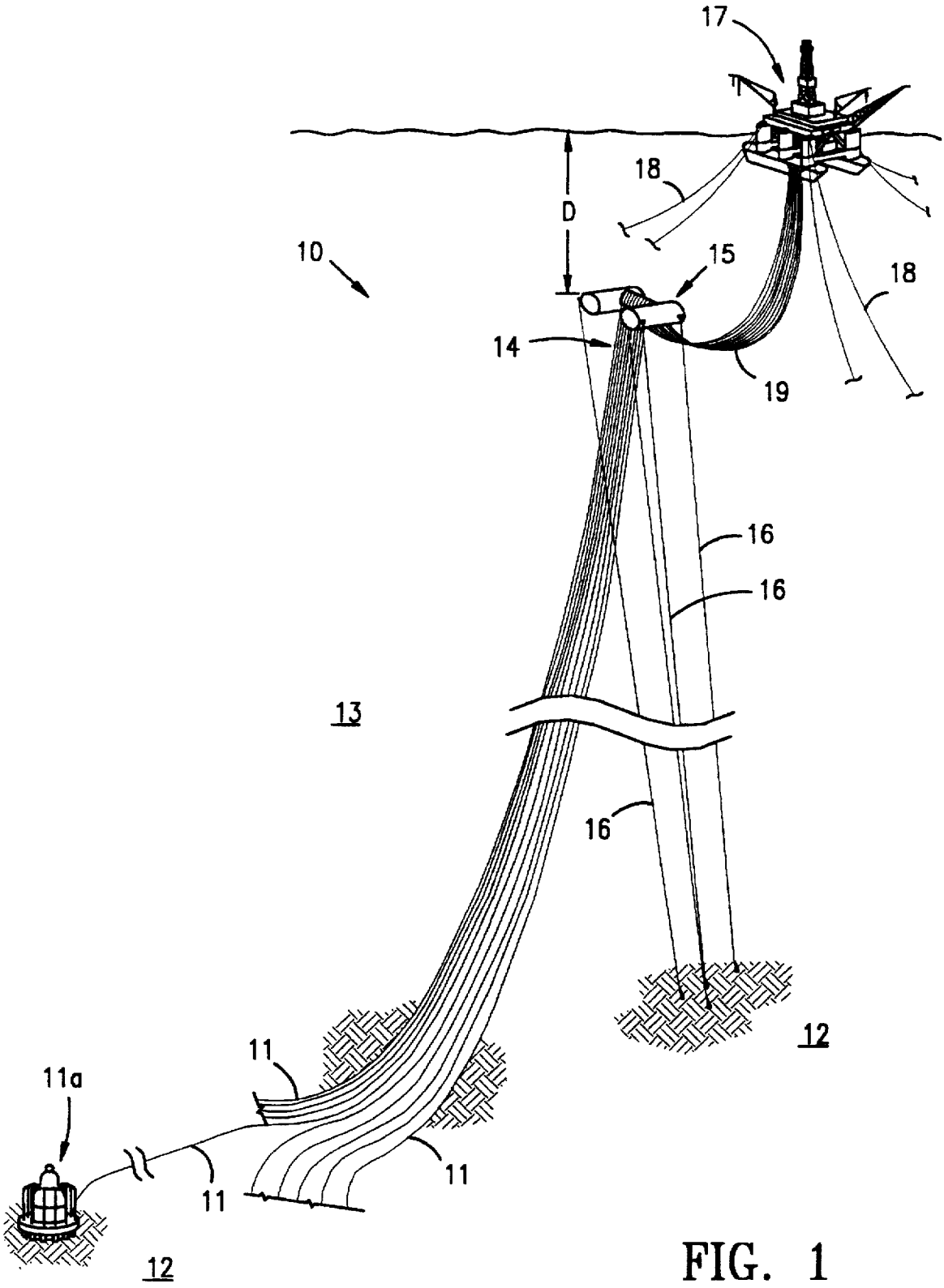
FIG. 1 is a perspective view of the present marine riser system installed in an operable position in a body of water at an offshore production area.

Referring more particularly to the drawings, FIG. 1 discloses the marine riser system 10 of the present invention which has been installed in an operable position at a deep-water, offshore location. Basically, riser system 10 is comprised of one or more rigid pipelines (e.g. steel pipelines) 11 which extend along the marine bottom 12 of the body of water 13 and which are adapted to be connected at one end to a respective fluid source such as a submerged well, a gathering manifold, other pipelines, submerged storage, etc., or a submerged production enclosure 11*a* such as shown in FIG. 1. As the pipelines are laid toward submerged buoy 15, the other or "free" end of each of the rigid pipeline 11 is curved upward to form a gentle catenary or steel catenary riser portion (SCR) 14.

Submerged buoy 15 is moored by "tensioned-leg" tether lines 16 to the marine bottom at a depth D (e.g. 100–150 meters) which is below the "turbulence zone" of the water body. As will be understood by those in the art and as used herein, the "turbulence zone" is that zone at and near the surface which is subject to surface and near-surface conditions which routinely cause substantial movement (e.g. drift, heave, roll, etc.) of the floating production and/or storage platform or vessel 17 which in turn, is normally moored to the marine bottom by lines 18 or the like.

SCR portions 14 of the rigid pipelines 11 are all connected to buoy 15. A flexible conduit 19 (commonly called "jumper") is then fluidly connected to a respective SCR 14 at the buoy 15 and extends from buoy 15 to the surface of the water where it is fluidly connected to floating facility or vessel 17 thereby providing the final fluid communication link to the surface.

There are basically three steps in the preferred method of installing the present riser system briefly described above: (1) installing the foundations, tethers 16, and buoy 15; (2) installing the pipelines and attaching the SCR portions thereof to the buoy; and (3) installing the flexible jumpers between the buoy 15 and the floating vessel 17.

Figure 2C:
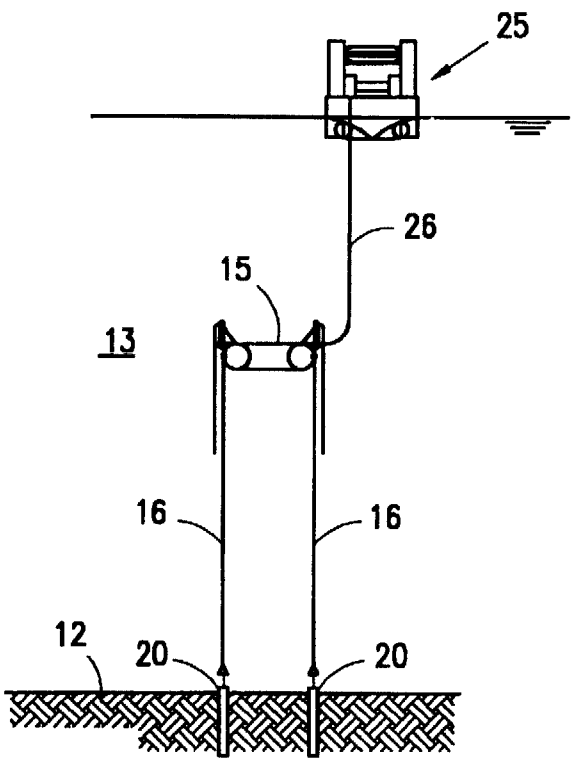
FIGS. 2A, 2B and 2C are illustrations of the steps involved in installing the submerged buoy of the FIGS. 3A, 3B, and 3C are illustrations of the steps involved in completing the installation of the present marine riser system in the body of water.
Figure 2B:
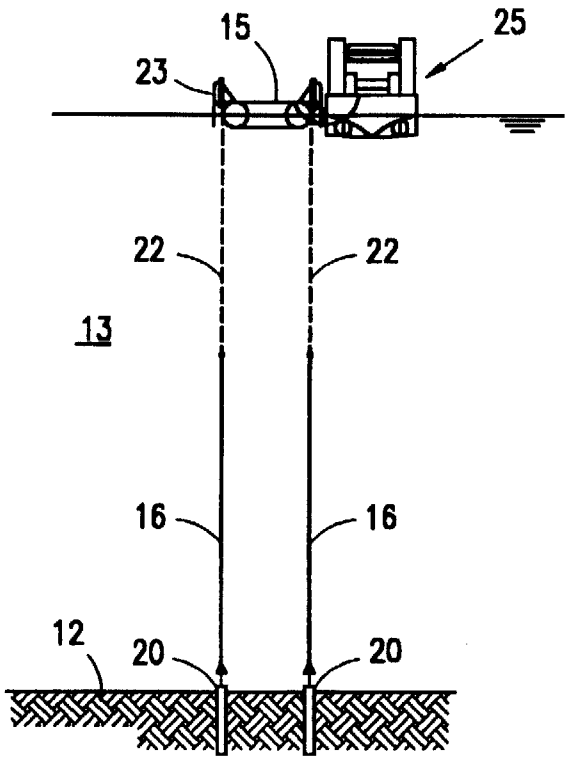
Figure 2A:
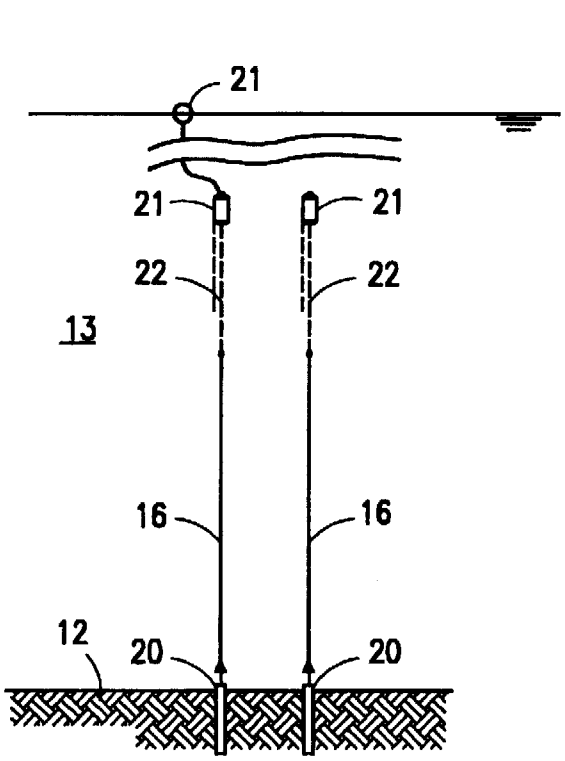

The mooring of buoy 15 at a depth D (e.g. 150 meters) below the surface action or turbulence zone requires careful planning and engineering, but the techniques required are all within the state-of-the-art. Several options are available and the best method for a particular application should be selected based on actual market conditions and the availability of work vessels and the like. Referring now to FIGS. 2A–2C, one preferred installation is illustrated.

Figure 3C:
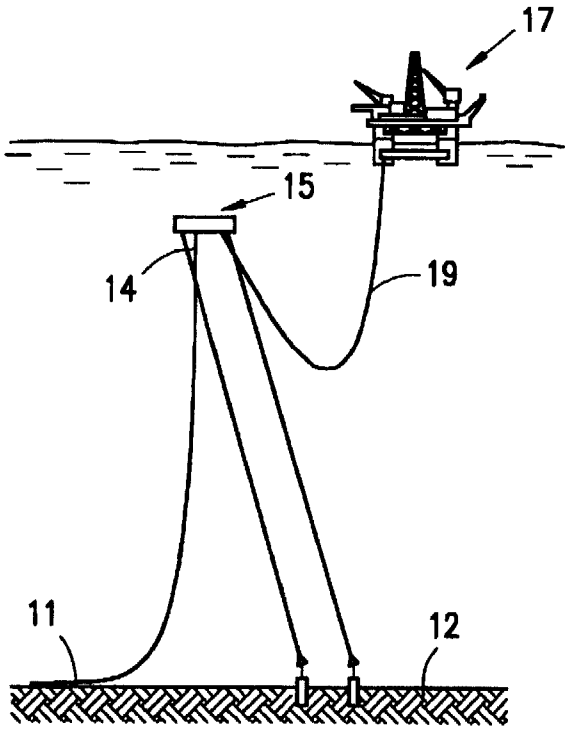

The foundations for mooring tether lines 16 to the marine bottom 12 must be able to take peak vertical loads as high as 1,500 tonnes which are comparable to the anchor pile loads experienced in known Tension Leg Platforms. Accordingly, foundation installation techniques similar to those used to install foundations for Tension Leg Platforms (e.g. drilled and grouted piles, suction installed piles, or other techniques depending on actual soil conditions and equipment available) can be used to install four piles 20 (only two shown in FIGS. 2 and 3) into the marine bottom 12.

Tethers 16 are connected to piles 20 and are temporarily supported in a vertical position by individual temporary buoys 21 which, in turn, are connected to the tops of tethers 16 by chains 22. As shown in FIG. 2A, the chains 22 can be doubled back and releasably secured in a way so that temporary buoys 21 will be submerged until the submerged buoy 15 is to be installed. A marker buoy 21a (only one shown) is used to mark and aid in retrieving the respective temporary buoys 21.

Tethers 16 are preferably formed from torque-balanced, spiral strand wire, similar to that used for permanent mooring systems and are selected to resist the net buoyancy of buoy 15 when the buoy is installed. The highest tension load normally will occur during installation. Loads should not vary substantially during operation due to the static nature of riser system 10 thereby eliminating fatigue problems. Tether load variations are minimized by attaching the SCRs 14 and the jumpers 19 near the center of buoyancy of buoy 15 as they are installed.

Buoy 15 is towed to site by service or work vessel 25 and the tether extensions 22 (e.g. chains) are released so that buoys 21 will bring the ends of extensions to the surface. The buoy 15 is then lowered using chain jacks 23 or the like located on the buoy, itself. Buoy 15 will be partially flooded during this operation to reduce tension in the tethers. Once connected to tethers 16, buoy 15 will be deballasted through umbilical 26 or the like to develop sufficient pretension and the chain jacks will be removed. Buoy 15 will be moored at a depth D at which divers can safely work. An alternate technique for connecting buoy 15 to the tethers is to use a heavy lift crane barge which are not uncommon in such marine areas.

The required net buoyancy of buoy 15 is determined by the weight of the SCRs 14, jumpers 19. and tethers 16 and by the range of horizontal motion encountered during SCR installation. A reserve buoyancy of roughly three to one should be available to insure the desired stability. Further, the net buoyancy of the buoy should be at least about two-to-three times the vertical loads imposed by the SCRs and jumpers. This excess buoyancy provides lateral stiffness to limit bending and facilitates installation of the SCRs. The lateral stiffness also limits motions of the buoy 15 due to the water current and the jumper horizontal loads.

The buoy is preferably compartmented to allow for the variable buoyancy needed for installation and for damage control. After installation, all compartments are dewatered with air so that the internal air pressure is slightly higher than the external water pressure thereby minimizing collapse and burst load design requirements for the buoy.

A tether 16 is attached at each of the "four corners" of buoy 15 thereby minimizing any rotation of the buoy due to horizontal forces. It should be recognized that while a particular buoy 15 may not have a rectangular configuration, but the tether attachment points (i.e. "four corners") on the buoy will lie in the same plane and define a rectangle if jointed by straight lines. Tethers 16 are connected to buoy 15 with end connectors (not shown) which are preferably similar to the tendon connections used with Tension Leg Platforms.

After buoy 15 is moored to the marine bottom (FIG. 3A), rigid pipelines or flowlines 11 are laid from remote submerged, fluid sources, (e.g. submerged wells, templates and/or export pipelines, submerged production enclosure 11*a* of FIG. 1, or the like) by any conventional submerged pipeline laying technique (e.g. J-lay or tow methods). SCRs 14 of the respective rigid pipelines 11 are merely a continuation of the pipelines 11, themselves, and are curved upward in a catenary path from the marine bottom to buoy 15 as they are being laid toward buoy 15.

Figure 3B:
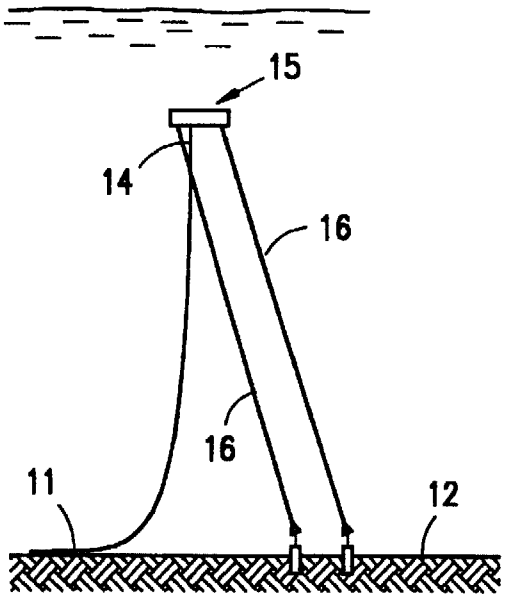
Figure 3A:
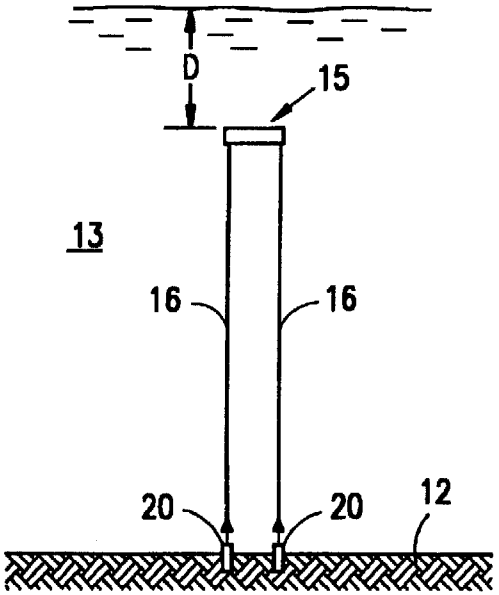

SCRs 14 are connected to buoy 15 one at time, in a planned sequence. As each SCR 14 is connected or attached to the buoy, the buoy 15 is pulled further off-center to a new equilibrium position. The buoy will also twist slightly on its vertical moorings, depending on the eccentricity of the load of the SCR. As pointed out above, variable buoyancy and tether spacing limit this effect. With all the SCRs connected, buoy 15 will be laterally displaced to its maximum extent (FIG. 3B). At this point, the tethered buoy is very stable.

Figure 4:
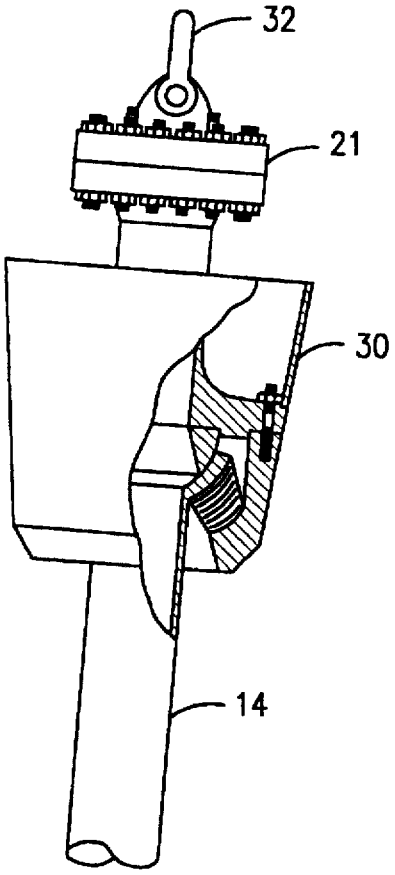
FIG. 4 is an elevational view, partly in section, of a connection can be used to connect a SCR to the submerged buoy of the present invention.
Figure 5:
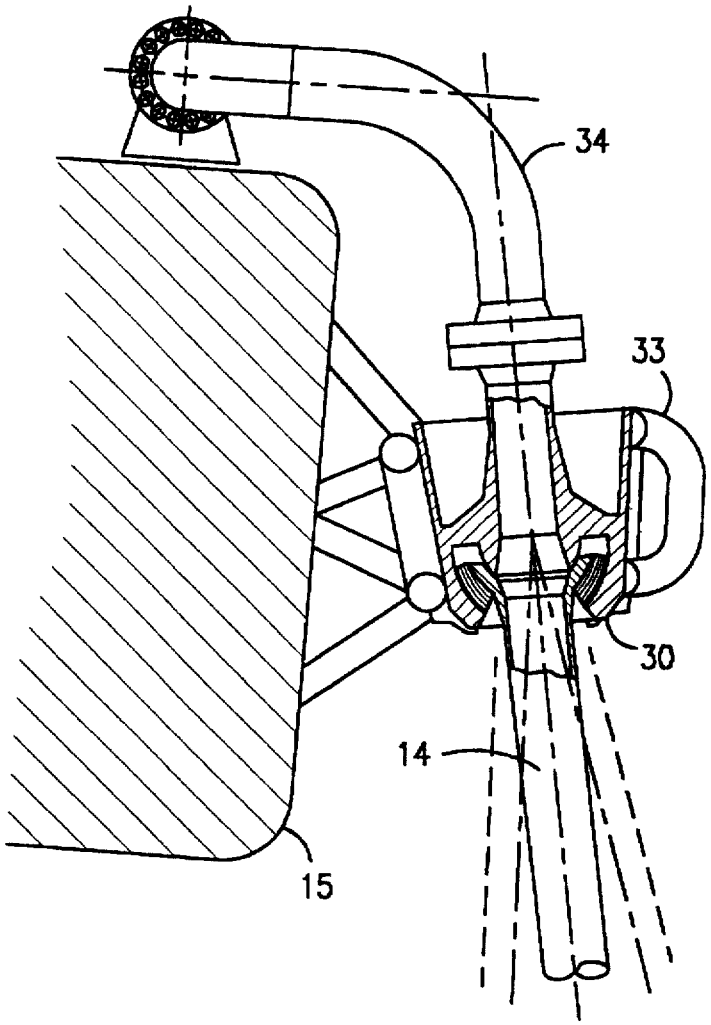
FIG. 5 is an elevated view, partly in section, of the connection of FIG. 4 after the SCR has been connected to the submerged buoy.

While various connectors and/or connecting techniques can be used to connect the SCRs 14 to buoy 15, FIGS. 4 and 5 illustrate one such technique. A tapered elastomeric flexjoint unit 30 is secured to the terminal end of SCR 14. Lift flange 31 having a heavy duty shackle 32 thereon is bolted or otherwise secured to flexjoint 30 and is used to pull the SCR upward to buoy 15. The flexjoint is then lowered into a receptacle 33 which is mounted on buoy 15 to thereby attach the SCR to the buoy. This is basically the same technique and structure used in connecting catenary risers (SCRs) directly to a floating vessel, see "Design and Installation of Auger Steel Catenary Risers", E. H. Phifer et al, OTC 7620, 26th Annual Offshore Technology Conference, Houston, Tex., May 2–5, 1994.

While flexjoints are illustrated, they may not always be required in attaching the SCRs to the buoy since the SCRs will be nearly vertical at the buoy and there will be little lateral motion and only minor rotation of the buoy. If flexjoints are used, they will not be subjected to any appreciable fatigue since the surge of the buoy is small and the buoy does not roll or pitch like the floating vessel 17. Accordingly, this reduction in load variations virtually eliminates fatigue concerns.

Buoy 15, tethers 16, and the SCRs can be pre-installed before floating production vessel 17 arrives on site, after which the flexible conduits (i.e. jumpers) 19 are connected to the SCRs 14 at buoy 15 by a spool 34 (FIG. 5) or the like. This is accomplished using conventional techniques available for this purpose, e.g. using a work boat containing reels of flexible conduit. It should be understood that, as used herein, the term "flexible" is meant to be a relative term in that a sufficient length of the conduit will form a rather slack catenary as it extends from the buoy to the vessel so that the compliancy thereof will effectively isolate the buoy 15 from the motions of vessel 17.

This means that metal pipe (e.g. steel, titanium, etc.) which might otherwise be considered to be rigid can be used to form jumpers 19 as well as more flexible conduit or hose (e.g. "COFLEXIP" pipe). Where metal pipe is used, approximately twice the length of a flexible hose or the like will be required to form a jumper 19 since a longer catenary will be needed to provide the necessary minimum bend radius. While twice the length of jumper 19 may be needed, the differences in price between metal pipe and the required flexible hose is such that the metal pipe is likely to still be cheaper to install. Further, even though metal pipe may experience more fatique than a hose, it can be readily replaced since all connections are at depths at which divers can effectively operate.

The actual lengths of jumpers 19 are determined by the material used and by the range of movement to be experienced by vessel 17. The minimum horizontal distance between the buoy and the vessel is usually limited by the minimum bend radius allowed for the particular flexible conduit used to form the jumpers. The maximum horizontal separation is usually limited by the angle range that can be accommodated by the bending stiffeners at the jumper attachment points with the allowable range of the vessel motion increasing as the length of the jumpers increase.

Further, since the jumpers 19 only lie in the shallower depths (e.g. 300 meters or less) of the body of water, they are not subjected to high tensile loads or high external hydrostatic pressures. It is, therefore, possible to use larger diameter flexible conduit than would be possible at greater water depths.

What is claimed is:

1. A marine riser system comprising:

a submerged buoy moored to the marine bottom of a body of water at a depth below the turbulence zone of said body of water;

at least one substantially rigid, flowline extending along the marine bottom having one end fluidly connected to a submerged, fluid source and its other end curving upward through a catenary and terminating at said buoy, said substantially rigid flowline lying on but being unattached to said marine bottom between said submerged fluid source and said other end; and a flexible flowline fluidly connected to said one end of said at least one rigid pipeline at said buoy and extending upward through said turbulence zone to said surface.

2. The marine riser system of claim 1 wherein said buoy has four mooring points in the same plane and spaced to effectively lie on four corners of a rectangle and four tether lines, each having one end connected to one of said mooring point on said buoy and another end connected to said marine bottom to thereby moor said buoy to said marine bottom.

3. The marine riser system of claim 2 wherein said all of said four tether lines are parallel to each other.

4. The marine riser system of claim 3 wherein said at least one rigid flowline is comprised of steel pipe.

5. The marine riser system of claim 4 including:

means for attaching said one end of said rigid flowline to said buoy. body of water.

6. A method for installing a marine riser system in a body of water comprising:

mooring a submerged buoy to the marine bottom at a depth below the turbulence zone of said body of water;

laying a rigid flowline on but unattached to the marine bottom between a submerged fluid source and said buoy;

attaching one end of said rigid flowline to said submerged fluid source and curving the other end of said rigid flowline in a catenary upward to said buoy; and fluidly connecting a flexible flowline to said one end of said rigid pipeline at said buoy, said flexible flowline extending from said buoy to the surface of said body of water.

7. The method of claim 6 wherein said step of mooring said buoy comprises:

attaching one end of each of four tether lines to a respective mooring point on said buoy and the other end of said each tether line to said marine bottom.

8. The method of claim 7 wherein said four tether lines are all parallel to each other.

9. The method of claim 8 including:

installing four piles into said marine bottom; and attaching said other end of each of tether line to a respective one of said four piles.

10. The method of claim 9 including:

attaching said one end of said rigid flowline to said buoy.

* * * * *

UNITED STATES PATENT AND TRADEMARK OFFICE

CERTIFICATE OF CORRECTION

PATENT NO. : 5,639,187

DATED : June 17, 1997

INVENTOR(S) : John C. H. Mungall, et al.

It is certified that error appears in the above-indentified patent and that said Letters Patent is hereby corrected as shown below:

Claim 5, column 7, line 11, after "buoy." delete

--"body of water"--

Signed and Sealed this

Second Day of September, 1997

*Attest:*

BRUCE LEHMAN

*Attesting Officer*

*Commissioner of Patents and Trademarks*